United States Patent [19]

Hoshizaki et al.

[11] Patent Number: 4,723,069

[45] Date of Patent: Feb. 2, 1988

[54] CERAMIC HEATER

[75] Inventors: Hiroki Hoshizaki, Anjo; Kazuo Oyobe, Ohbu; Hirofumi Suzuki, Kariya; Nobuaki Kawahara, Anjo; Terutaka Kageyama, Kariya; Hitoshi Niwa, Okazaki; Shinichi Takeshima, Susono; Yoshihiko Imamura, Susono; Kiyoshi Kobashi, Mishima; Kenichiro Takama, Susono, all of Japan

[73] Assignees: Toyota Jidosha Kabushiki Kaisha, Toyota; Nippondenso Co., Ltd., Kariya, both of Japan

[21] Appl. No.: 907,818

[22] Filed: Sep. 16, 1986

[30] Foreign Application Priority Data

Sep. 26, 1985 [JP] Japan ..... 60-212802

[51] Int. Cl.[4] ..... H05B 3/06; F23Q 7/10

[52] U.S. Cl. ..... 219/521; 219/525; 219/536; 219/537; 219/552; 219/553; 338/333; 60/303

[58] Field of Search ..... 219/521, 525, 536, 537, 219/552, 553, 381, 382, 374; 338/330, 333; 60/295, 303

[56] References Cited

U.S. PATENT DOCUMENTS 3,681,737 8/1972 Magnusson et al. ..... 338/330 X
3,875,477 4/1975 Fredriksson et al. ..... 219/553 X
4,555,358 11/1985 Matsushita et al. ..... 219/553 X

FOREIGN PATENT DOCUMENTS 60-127685 7/1985 Japan .

*Primary Examiner*—Patrick R. Salce
*Assistant Examiner*—Emanuel Todd Voeltz
*Attorney, Agent, or Firm*—Cushman, Darby & Cushman

[57] ABSTRACT

A ceramic heater for regenerating a fine particle collecting filter which is exposed to exhaust gases at elevated temperatures. This ceramic heater comprises two electrode potions, a heat generation portion connected to the two electrode portions and a holding projection portion of a ceramic heater connected to the side of the heat generating portion. The two electrode portions, the heat generating portion and the holding projection portion are formed integrally.

20 Claims, 10 Drawing Figures

CERAMIC HEATER

BACKGROUND OF THE INVENTION

1. Field of the Invention

The present invention relates to an improvement of a ceramic heater and particularly it is applied to a heater for the regeneration of an apparatus for collecting and purifying fine particles contained in the exhaust gas of a diesel engine or the like.

2. Description of the Related Art

For collecting and purifying fine particles contained in the exhaust gas, it has been proposed to use a heat-resistant honeycomb- or foam-like filter made of a ceramic material and to fire and burn the collected fine particles by means of a heat-resistant ceramic heater disposed on an upper surface of the filter to regenerate the filter.

In this case, rectangular plate-like heaters as shown in FIG. 8 or plate-like heaters formed in the shape of U or V as shown in FIG. 9 have been proposed. Moreover, it has been considered desirable to dispose a plurality of these heaters in a filter.

All these heaters have a common method of holding a heater, which is based on an electrode cantilever holding structure. That is, one side electrode is fixed completely to a case by welding as an earth terminal, and a plus side electrode is capable of sliding freely with an opening or closing motion of heater legs which is caused by heating and cooling of the heater.

In the U- or V-shaped heater, if the plus-side electrode in addition to the minus-side electrode is completely fixed to the case, stress is concentrated on a bent portion and the heater breaks easily. Moreover, if the heater having an electrode cantilever holding structure is installed in an engine, engine vibrations are conveyed to the heater, and the bent portion vibrates badly. Accordingly, the attached portion of the minus-side electrode to the case tends to be weak in strength.

Usually, a U- or V-shaped heater is connected at its both end electrode portions 3' to metallic lead wires for example as shown in FIG. 9 and is thereby charged electrically and heated, so with a view to protecting the electrode portions the sectional area of the electrode portions is made fairly larger than that of a heat generating portion to suppress the heat generation at the electrode portions.

However, in a conventional ceramic heater there arises an opening-closing motion of leg portions in the course of heat generation and cooling due to thermal expansion, and once the heater is fixed to a holding portion, the above motion is impeded by friction, for example, and stress is concentrated on a bent portion 2a'. This stress concentrated on a bent portion 2a' is proportional to moment of an external force exerted on the leg portion and a length (Lo) from the leg portion to the bent portion 2a'. Consequently, this shape causes the problem of stress being concentrated on the bent portion 2a', and the repeated supply of electricity results in cracking of the bent portion.

The above conventional ceramic heater also involves the problem that when it is disposed on the filter surface, it is impossible to heat the filter surface widely because the area of heat generation is small in comparison with the large space of the electrode portions.

Accordingly, one of the applicants of the present invention provided a ceramic heater (Japanese patent application No. 60-3459 from which priority is claimed in Hoshizaki et al Ser. No. 816,868 filed in January 1986) capable of preventing stress concentration during heat generation of the heater, ensuring a uniform heating property, also ensuring a large heat generating area and facilitating the handling of electrodes. The ceramic heater of the unpublished related application is a ceramic heater in which two electrode portions 35a and 35b are provided on a single straight line or curved line $m_5$ and a heat generating portion is positioned on one side of the line, for example, as shown in FIG. 10.

The above heat generating portion comprises a closed loop portion 15 and two leg potions 25a and 25b integrally connected to the ring-like portion 15 at two connecting portions 15c and 15d which approximately bisect the closed loop portion 15. The two electrode portions 35a and 35b are each provided at fore ends of the two leg portions 25a and 25b respectively.

This ceramic heater is characterized by having a construction in which the closed loop portion 15 and the two electrode portions 35a and 35b conjointly form a triangle.

However, in even the above ceramic heater, holding method of the heater can take only an electrode cantilever holding structure. Therefore, the problem that cracks are frequent at the minus-side electrode connected to the earth occurs as well as a conventional ceramic heater.

SUMMARY OF THE INVENTION

The present invention overcomes the above-mentioned drawbacks and it is an object to provide a ceramic heater capable of preventing stress concentration during heat generation of the heater, ensuring a uniform heating property, also ensuring a large heat generating area and facilitating the handling of electrodes.

It is another object to provide a ceramic heater capable of avoiding a vibration concentration on the electrode portions by changing the heater holding position to thereby reduce cracking or separation at the electrode portions.

The ceramic heater of the present invention comprises two electrode portions, a heat generating portion connected to the two electrode portions and a holding projection portion of a ceramic heater connected to the side of the heat generating portion.

This ceramic heater is characterized by integrally forming the two electrode portions, the heat generating portion and the holding projection portion.

BRIEF DESCRIPTION OF THE DRAWINGS

The exact nature of this invention, as well as other objects and advantages thereof, will be readily apparent from consideration of the following specification relating to the annexed drawings in which.

DETAILED DESCRIPTION OF THE INVENTION

The ceramic heater of the present invention comprises two electrode portions, a heat generating portion connected to the two electrode portions and a holding projection portion of a ceramic heater connected to the side portion of the heat generating portion.

This ceramic heater is characterized by integrally forming the two electrode portions, the heat generating portion and the holding projection portion.

The above electrode portions are for supplying an electric current to the ceramic heater to allow the heater to generate heat.

Figure 5:
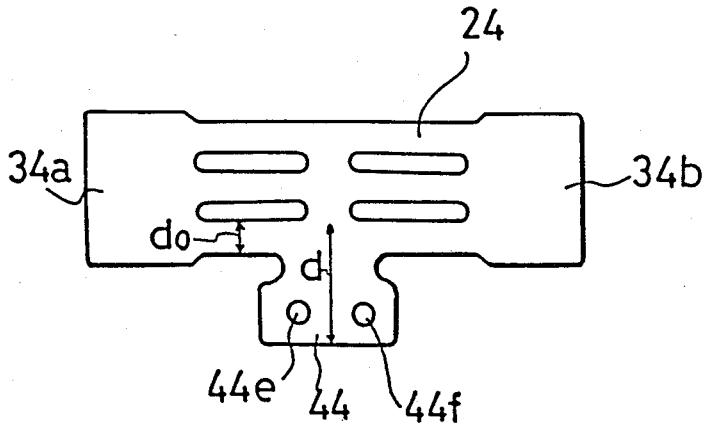
FIG. 5 is a plan view of a ceramic heater having a rectangular heat generating portion according to Embodiment 3.

The electrode portions can be connected to one side of a rectangular heat generating portion as shown in FIG. 5.

Figure 1:
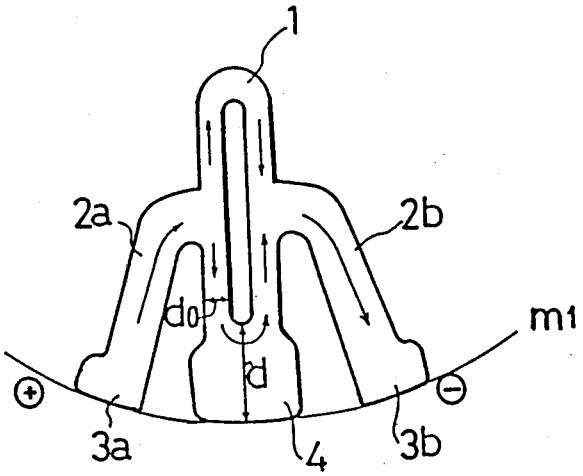
FIG. 1 is a plan view of a ceramic heater of this invention having a heat generating portion whose center is closed loop portion.
Figure 2:
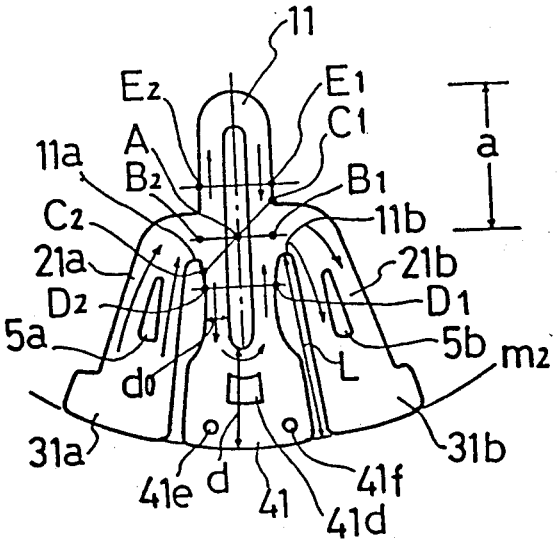
FIG. 2 is a plan view of a ceramic heater having a heat generating portion whose center is closed loop portion according to Embodiment 1.
Figure 3:
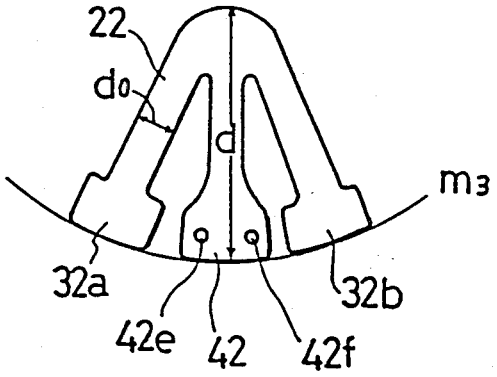
FIG. 3 is a plan view of a ceramic heater having a V-shaped heat generating portion according to Embodiment 2.
Figure 4:
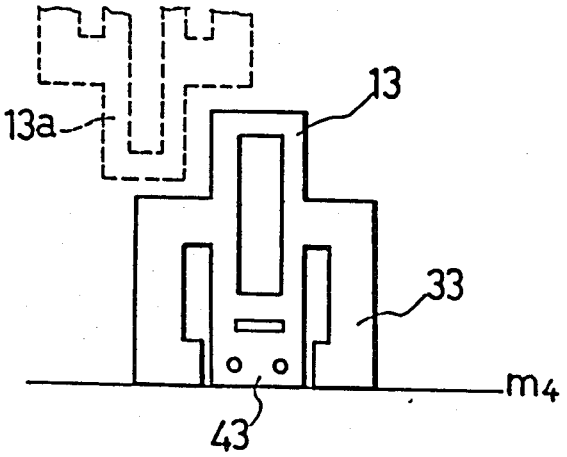
FIG. 4 is a plan view of a ceramic heater having a rectangular closed loop portion according to this invention.

They are provided, for example, on a single curved line $m_1$, $m_2$ or $m_3$ as shown in FIGS. 1, 2 or 3 or on a single straight line $m_4$ as shown in FIG. 4, and at fore ends of the leg portion 2*a* and 2*b* as shown in FIG. 1. The electrode portions, in plan view, may be larger than the leg portions and have convexes in the line directions, as shown in FIGS. 1 and 2. The convexes may be disposed outside as shown in FIG. 1 or may be disposed inside as shown in FIG. 4. In the latter case, a larger heat generation area can be ensured when plural ceramic heaters are combined. In the former case, the area of a heater holding projection portion can be larger.

The above heat generating portion may be V-shaped as shown in FIG. 3, may be U-shaped or may be rectangular as shown in FIG. 5.

Moreover, the heat generating portion may be positioned on one side of the above line and comprises the closed loop portion 1 and the two leg portions 2*a* and 2*b*, respectively, integrally connected to the closed loop portion 1 at the two connecting portions which approximately bisect the closed loop portion 1, for example as shown in FIG. 1.

The closed loop portion may be positioned nearly centrally of the ceramic heater to constitute a main heat generating portion. As to the shape of the closed loop portion, the plan shape, whether long and short diameters are present or not, the ratio of long to short diameter, the ring width and the like are not specially limited. For example, the closed loop portion may be in the shape of a track-like ellipse as shown in FIGS. 1 and 2, a circle (not shown) or a rectangle as shown in FIG. 4.

The two leg portions are integrally connected to the closed loop portion at the two connecting portions which approximately bisect the closed loop portion. The expression "approximately bisect" means that, as shown in FIG. 2, in order to ensure a uniform heating property, the two connecting points may be $B_1$ and $B_2$, or $C_1$ and $C_2$, which bisect the closed loop portion 11 by a straight line which passes through a center A of the closed loop portion 11 and that the connecting points are within a vertical range corresponding to one third of a long radius "a" from the points $B_1$ and $B_2$, that is, the left-hand connecting point is within the range of between $D_2$ and $E_2$, while the right-hand connecting point is within the range of between $D_1$ and $E_1$. The connecting portions are preferably connected on a short diameter side in the case of a ring having short and long diameters.

The leg portions, which connect the closed loop portion with the two electrode portions, can constitute a sub heat generating portion. They may have about the same width through the total length as shown in FIG. 1 or may be divergent toward their fore ends and have slits 5*a* and 5*b* formed in a direction parallel to the extending direction of the leg portions 21*a* and 21*b* as shown in FIG. 2. The number and shape of the slits are not specifically limited, but preferably the slits are formed in a direction parallel to the extending direction of the leg portions so that the leg portions are each almost constant in cross sectional area, as shown in FIG. 2.

A cantilever ceramic heater has preferably a construction in which the above closed loop portion and the above two electrode portions conjointly form a triangle. This makes it easy to combine a plurality of the ceramic heaters to enlarge the heater surface area.

The above holding projection portion is provided for holding the ceramic heater. The holding projection portion may be of any structure as long as the holding projection portion is connected to the side of the above heat generating portion and the ceramic heater is held thereby. A connecting position of the holding projection portion is preferably in the nearly middle of the side of the heat generating portion. In this case, this heater can be held to balance itself. In the case of a cantilever ceramic heater, for example as shown in FIG. 1, the holding projection portion may be approximately square 4 which is connected to electrode-side portions of the closed loop heat generating portion 1 and disposed on a single curved line $m_1$, or as shown in FIG. 3, may be inverse T-shape 42 which is connected under the top of the V-shaped heat generating portion (electrode-side portions) and the bottom T-portion of the inverse T-shape 42 as well as the electrode portions 32*a*, 32*b* is disposed on a single curved line $m_3$. The holding projection portion may be approximately square one side of which is the same length as the short side of the rectangular closed loop portion as shown in FIG. 4. Moreover, the holding projection portion may be rectangular 44 which is connected to nearly the middle of the long side of the rectangular heat generating portion as shown in FIG. 5. An entire shape of the holding projection portion is not limited to the above shape, but selected variously by means of its object and use. And the number of the holding projection portion is usually one, but not limited to this.

It is preferable that the width (e.g. "d" in FIG. 1 to FIG. 4) in a direction perpendicular to the current flowing direction of the holding projection portion is not less than twice the width (do) in a direction perpendicular to the current flowing direction of the heat generating portion.

Moreover, the holding projection portion preferably has a hole 41*d* formed on the side closer to the heat generating portion for the prevention of flowing-in of current and for the prevention of heat conduction from the heat generating portion, for example as shown in FIG. 2. Further, it is preferable that the holding projection portion have tapped holes 41*e* and 41*f* for fixing the ceramic heater as shown in FIG. 2 for example.

As an entire shape, the above ceramic heater may have various triangular shapes, T-shapes (FIG. 5) or convex shapes. For example as a triangular shape, as shown in FIGS. 1 and 2, the ceramic heater is preferably in the shape of an isosceles triangle whose base is a line joining the electrode portions. This is because when a plurality of ceramic heaters are combined in a circular shape, the entire area of the circle can be covered equally. As a convex shape, plural ceramic heaters may be combined in such a fashion as shown in FIG. 4 in which each ceramic heater is of a square shape having a projecting top part and a plurality of such ceramic heaters are combined in a parallel direction opposedly to each other.

Figure 6:
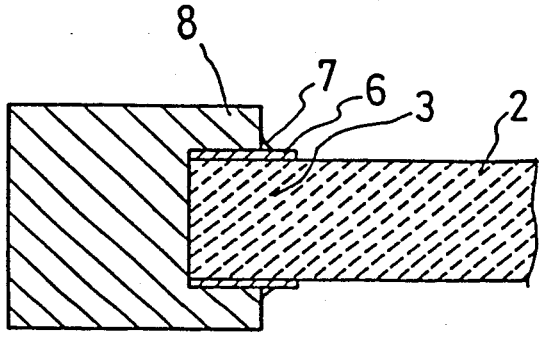
FIG. 6 is a partially sectional view of a ceramic heater having a metallized layer on the surface thereof and a metal electrode disposed on the surface of the metallized layer.

The electrode portions may each include a metallized layer integrally formed on the surface of a fore end of each leg portion. The material of the metallized layer is not specially limited: it may be a material usually employed. Preferably the metallized layer is so formed as to cover almost the entire surface of each electrode portion. Further, on the surface side of the metallized layer 6 there may be disposed a metal electrode 8 as shown in FIG. 6. The metal electrode may be of a shape which presses an end portion of the ceramic heater as shown in FIG. 6, or it may be an electrode plate with a lead wire bonded thereto.

There may be formed a solder material layer 7 to bond the metallized layer 6 and the metal electrode 8 together as shown in FIG. 6. Although the material of the solder material layer is not specially limited, there is usually employed nickel or the like having heat resistance.

The ceramic heater can be fabricated by mixing powder of a conductive ceramic (e.g. titanium nitride) which constitutes an heating element and an insulating material powder (e.g. silicon nitride), then forming the resulting powdery mixture into a predetermined shape and calcining the thus-shaped ceramic to obtain a sintered ceramic product as the ceramic heater.

As set forth above, the ceramic heater of the present invention has a holding projection portion connected to the side of the heat generating portion. Thus, the heater can be held with a good balance and the electrode portions can be kept free by fixing the holding projection portion to the case with an insulator held therebetween, whereby it is possible to prevent engine vibrations from being concentrated on the electrode portions. In this shape, moreover, opening and closing motions of the leg portions during heat generation and cooling of the heater can be eliminated at the holding projection portion, and since expansion and contracting at the holding projection portion occur in an axial direction passing through the fore end, no stress concentration will be induced thereby. Consequently, it is possible to reduce cracking or separation at the electrode portions of the ceramic heater and hence it is possible to reduce a defective current supply.

DETAILED DESCRIPTION OF THE EMBODIMENTS

The following embodiments are given to further illustrate the present invention.

Embodiment 1

A ceramic heater according to this embodiment comprises, as shown in FIG. 2, two electrode portions 31*a* and 31*b*, heat generating portions comprising a closed loop portion 11 and two leg portions 21*a* and 21*b* connected to those electrode portions 31*a* and 31*b*, and a holding projection portion 41 connected to electrode-side portions of the closed loop portion 11. The two electrode portions 31*a* and 31*b*, the heat generating portions 11, 21*a*, 21*b* and the holding projection portion 41 are integrally formed.

According to this embodiment, two electrode portions 31*a* and 31*b* are provided on a single curved line $m_2$ and the heat generating portion connected to the electrode portions 31*a* and 31*b* is positioned on one side of the line $m_2$, the heat generating portion comprises a closed loop portion 11 and two leg portions 21*a* and 21*b* integrally connected to the closed loop portion 11 at two connecting portions $B_1$ and $B_2$ which bisect the closed loop portion 11. The closed loop portion 11 is in the shape of a track-like ellipse having a short to long diameter ratio of 2:9, and the two connecting portions $B_1$ and $B_2$ are positioned on a line of the short diameter.

The two leg portions 21*a* and 21*b* are divergent toward their fore ends and respectively have triangular slits 5*a* and 5*b* in a direction parallel to the extending direction of the leg portions. The ceramic heater as a whole is in the shape of an isosceles triangle having a vertical angle of about 60° and an isosceles length of 70 mm. In this case, the distance (L) from the fore ends of the electrode portions 31*a* and 31*b* to base ends 11*a* and 11*b* of the bent portions is 30 mm.

The holding projection portion 41 is approximately square and the width (d) in a direction perpendicular to the current flowing direction thereof is 18 mm, which is about three and a half times as large as the width (do) in a direction perpendicular to the current flowing direction of the heat generating portion. On the side close to the heat generating portion, the holding projection portion 41 has a hole 41*d* for the prevention of current flowing-in and for the prevention of heat conduction from the heat generating portion and also has two tapped holes 41*e* and 41*f* for fixing the ceramic heater. Insulation treatment is effected by applying a ceramic insulator to the case by spray coating. The ceramic heater was fixed through bolts.

The ceramic heater comprises 35 wt % of titanium nitride, 57 wt % of silicon nitride, 4 wt % of spinel as a sintering assistant and 4 wt % of yttrium oxide as a sintering assistant.

This ceramic heater was fabricated by mixing 35 wt % of titanium nitride having an average particle size of 1 μm, 57 wt % of silicon nitride having an average particle size of 0.8 μm, 4 wt % of spinel as a sintering assistant and 4 wt % of yttrium oxide as a sintering assistant, according to a wet process, drying the resulting mixture in a dryer together with a small amount of polyvinyl alcohol as a binder to obtain a molding powder, then pressing the powder in a heater shape by means of a mold press, followed by calcining in a nitrogen atmosphere at 1,800° C. for 2 hours, and baking nickel paste to terminal portions of the resulting ceramic heater in a hydrogen atmosphere at 1,200° C. for 1 hour.

The ceramic heater of the present invention has its holding projection portion 41 connected to the electrode-side portions of the heat generating portion. Therefore, the electrode portions 31*a* and 31*b* can be kept free by fixing the holding projection portion 41 to the case with an insulator held therebetween, whereby it is possible to prevent engine vibrations from being concentrated on the electrode portions 31*a* and 31*b*. In this shape, moreover, opening and closing motions of the leg portions 21*a* and 21*b* during heat generation and cooling of the heater can be eliminated. Since expansion and contraction at the holding projection portion 41 occur in an axial direction passing through the fore end, no stress concentration will be induced thereby. Consequently, it is possible to reduce cracking or separation at the electrode portions 31*a* and 31*b* of the ceramic heater and hence it is possible to reduce a defective current supply.

Moreover, in the ceramic heater, the holding projection portion 41 is approximately square and the width (d) in a direction perpendicular to the current flowing direction thereof is about three and a half times as large as the width (do) in a direction perpendicular to the current flowing direction of the heating element. On the side close to the heat generating portion, the holding projection portion 41 has a hole 41*d* for the prevention of current flowing-in and for the prevention of heat conduction from the heat generating portion and also has two tapped holes 41*e* and 41*f* for fixing the ceramic heater. Accordingly, as shown by arrows in FIG. 2, a current flows to the center closed loop portion 11 and hardly flows to the holding projection portion 41. Thus the heat generation can be reduced at the holding projection portion 41.

Moreover, in this ceramic heater, since the heat generating portion has a closed loop portion 11, a bent portion is divided into two portions. Also the distance (L) from the fore ends of the electrode portions 31*a* and 31*b* to the bent portion is shorter than that of a conventional heater. Therefore, it is possible to prevent stress concentration during heat generation of the heater and attain an enhanced breaking strength compared with the conventional V-shaped ceramic heater.

Figure 7:
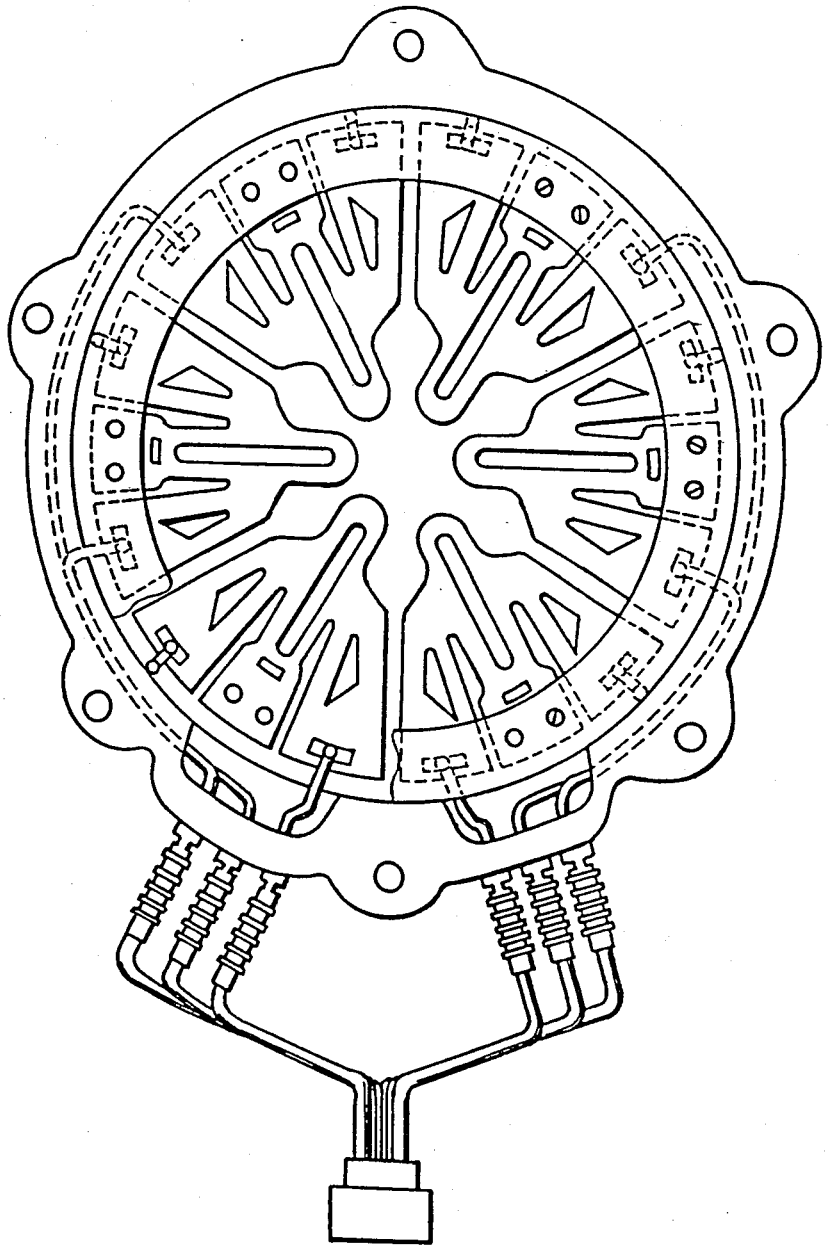
FIG. 7 is a plan view of a heating apparatus comprising six ceramic heaters according to Embodiment 1.
Figure 8:
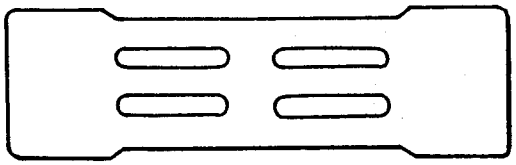
FIG. 8 is a plan view of a conventional ceramic heater having a rectangular heat generating portion.
Figure 9:
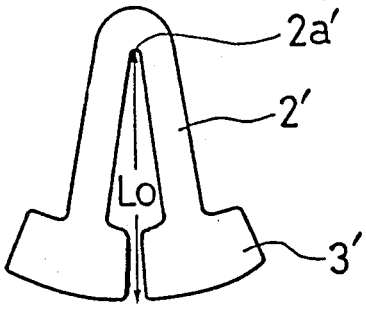
FIG. 9 is a plan view of a conventional ceramic heater having a V-shaped heat generating portion.
Figure 10:
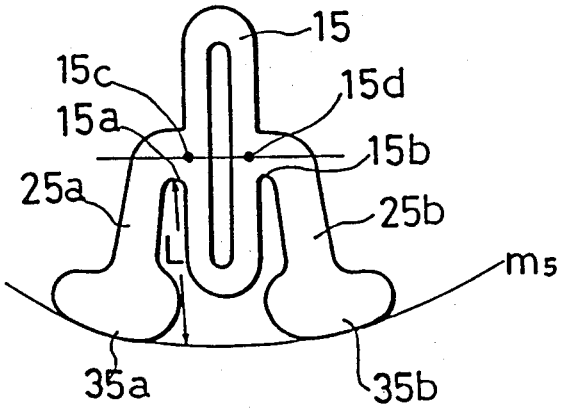
FIG. 10 is a plan view of a ceramic heater having a closed loop heat generating portion according to the unpublished related art.

Moreover, this ceramic heater is extremely superior in uniform heating property, because the ring-like portion and the leg portions 21*a* and 21*b* are about the same in cross sectional area. Since the holding projection portion 41 is symmetrically disposed on a single curved line, this ceramic heater is held with a good balance and is superior in holding strength. Additionally, since this ceramic heater as a whole is in the shape of an isosceles triangle having a vertical angle of 60°, the heat generation area can be enlarged by combining six such heaters circularly as shown in FIG. 7.

Embodiment 2

A ceramic heater according to this embodiment comprises, as shown in FIG. 3, two electrode portions 32*a* and 32*b*, V-shaped heat generating portion 22 connected to those electrode portions 32*a* and 32*b*, and a holding projection portion 42 connected to electrode-side portion of the heat generating portion 22. The two electrode portions 32*a*, 32*b*, the heat generating portion 22 and the holding projection portion 42 are integrally formed. The two electrode portions 32*a* and 32*b* are provided on a single curved line $m_3$.

The holding projection portion 42 is inverse T-shape and the width (d) in a direction perpendicular to the current flowing direction thereof is 70 mm, which is about seven times as large as the width (do) in a direction perpendicular to the current flowing direction of the heat generating portion. And the holding projection portion 42 has two tapped holes 42*e* and 42*f* for fixing the ceramic heater. Insulation treatment is side by spray coating. The ceramic heater was fixed through bolts.

The components and manufacturing method of this ceramic heater are the same as in Embodiment 1.

In this ceramic heater, as well as the ceramic heater according to Embodiment 1, it is possible to reduce cracking or separation at the electrode portions 32*a* and 32*b* of the ceramic heater and hence it is possible to reduce a defective current supply.

Embodiment 3

A ceramic heater according to this embodiment is a plate-like heater as shown in FIG. 5, and comprises two electrode portions 34*a* and 34*b*, a plate-like heat generating portion 24 connected to those electrode portions 34*a* and 34*b*, and a holding projection portion 44 connected to the side of the heat generating portion 24. The two electrode portions 34*a*, 34*b*, the heat generating portion 24 and the holding projection portion 44 are integrally formed. In the heat generating portion 24, four slots are provided along the flowing direction of the electric current.

The holding projection portion 44 is approximately square and the width (d) in a direction perpendicular to the current flowing direction is 20 mm, which is about four times as large as the width (do) in a direction perpendicular to the current flowing direction of the heat generating portion. The holding projection portion 44 has two tapped holes 44*e* and 44*f* for fixing the ceramic heater. Insulation treatment is effected by applying a ceramic insulator to the case side by spray coating. The ceramic heater was fixed through bolts.

The components and the manufacturing method of this ceramic heater are the same as in Embodiment 1.

In this ceramic heater, as well as the ceramic heater according to Embodiment 1, it is possible to reduce cracking or separation at the electrode portion 34*a* and 34*b* of the ceramic heater and hence it is possible to reduce a defective current supply.

What is claimed is:

1. A ceramic heater comprising:

two electrode portions, a heat generating portion connected to said two electrode portions, and a holding projection portion which is connected to said heat generating portion and which includes means for fixing said ceramic heater to a support structure, said two electrode portions, said heat generating portion and said holding projection portion being formed integrally.

2. A ceramic heater according to claim 1, wherein the width perpendicular to a current flowing direction of said holding projection portion is not less than two times the width perpendicular to the current flowing direction of said heat generating portion.

3. A ceramic heater according to claim 1, wherein said holding projection portion has at least one hole formed on its side close to said heat generating portion for the prevention of flowing-in of an electric current and the prevention of heat conduction from said heat generating portion.

4. A ceramic heater according to claim 1, wherein said holding projection portion has at least one through hole for fixing the ceramic heater to another structure.

5. A ceramic heater according to claim 1, wherein said two electrode portions are provided on a single curved line and said heat generating portion is positioned on one side of said line, said heat generating portion comprising a ring-like portion and two leg portions integrally connected to said closed loop portion at two connecting portions which approximately bisect said closed loop portion, said two electrode portions being provided at fore ends of said two leg portions respectively, said closed loop portion and said two electrode portions conjointly forming a triangle.

6. A ceramic heater according to claim 1, wherein said two electrode portions are provided on a single curved line and said heat generating portion is positioned on one side of said line, said heat generating portion being V-shaped, said holding projection portion being inverse T-shaped connected under the top of said V-shaped heat generating portion.

7. A ceramic heater according to claim 1, wherein said two electrode portions are provided on a single straight line and said heat generating portion is positioned on one side of said line, said two electrode portions being rectangular and having convexes disposed inside, said heat generating portion comprising a rectangular closed loop portion and two leg portions, said holding projection portion being approximately square one side of which is the same length as the short side of said rectangular closed loop portion.

8. A ceramic heater according to claim 1, wherein said heat generating portion is rectangular and has four slots provided along the flowing direction of electric current, and said holding projection portion is rectangular connected to nearly middle-side portion of the long side of said heat generating portion.

9. A ceramic heater according to claim 1, which is constituted by an electrically conductive ceramic comprising titanium nitride and silicon nitride.

10. A ceramic heater according to claim 1, wherein said electrode portions are each constituted by a metallized layer integrally formed on the surface of a fore end of each said leg portion.

11. A ceramic heater capable of being cantilevered, comprising:

two electrode portions provided on a single curved line, a heat generating portion positioned on one side of said line, said heat generating means having a closed loop portion and two leg portions integrally connected to said loop portion at two connecting portions which approximately bisect said closed loop portion, said two electrode portions being provided at fore ends of said two leg portions respectively and opposing to each other, and a holding projection portion, which fixes said ceramic heater to a support structure, being integrally connected to said closed loop portion and disposed between said two electrode portions;

said two electrode portions and said holding projection portion being disposed in the same plane constituted by said closed loop portion;

said closed loop portion and said two electrode portions conjointly forming a triangle.

12. A ceramic heater according to claim 11, wherein said closed loop portion is in the form of a track-like ellipse and said two connecting portions are positioned on a short radius line.

13. A ceramic heater according to claim 11, which is as a whole in the form of an isosceles triangle whose base is a line joining said electrode portions.

14. A ceramic heater according to claim 11, wherein said leg portions are divergent toward their fore ends and has slits in parallel with the extending direction of said leg portions.

15. A ceramic heater according to claim 11 wherein the width perpendicular to a current flowing direction of said holding projection portion is not less than two times the width perpendicular to the current flowing direction of said heat generating portion.

16. A ceramic heater according to claim 11 wherein said holding projection portion has at least one whole formed on its side close to said heat generating portion for the prevention of flowing-in of an electric current and the prevention of heat conduction from said heat generating portion.

17. A ceramic heater according to claim 11 wherein said holding projection portion has at least one through hole for fixing the ceramic heater to said support structure.

18. A ceramic heater according to claim 11 which is constituted by an electrically conductive ceramic comprising titanium nitride and silicon nitride.

19. A ceramic heater according to claim 11 wherein said electrode portions are each constituted by a metallized layer integrally formed on the surface of a fore end of each said leg portion.

20. A ceramic heater as in claim 1 wherein said electrode portions and holding projection portion have fore ends extending along a given line, said holding projection portion being separated from said electrode portions and extending along said line for at least a distance equal to the distance each of said electrode portions extend therealong.

* * * * *